US009617788B2

(12) United States Patent
Goodson

(10) Patent No.: US 9,617,788 B2
(45) Date of Patent: Apr. 11, 2017

(54) CABINET MOUNTED STEP STOOL

(71) Applicant: John W. Goodson, Boulder, CO (US)

(72) Inventor: John W. Goodson, Boulder, CO (US)

( * ) Notice: Subject to any disclaimer, the term of this patent is extended or adjusted under 35 U.S.C. 154(b) by 0 days.

(21) Appl. No.: 14/319,724

(22) Filed: Jun. 30, 2014

(65) Prior Publication Data

US 2015/0001005 A1 Jan. 1, 2015

Related U.S. Application Data

(60) Provisional application No. 61/840,785, filed on Jun. 28, 2013.

(51) Int. Cl.

| | |
|---|---|
| ***E06C 1/00*** | (2006.01) |
| ***A47B 77/00*** | (2006.01) |
| ***A47B 77/10*** | (2006.01) |

(52) U.S. Cl.

CPC ..... *E06C 1/005* (2013.01); *A47B 77/00* (2013.01); *A47B 77/10* (2013.01); *A47B 2220/05* (2013.01)

(58) Field of Classification Search

CPC ..... A47C 12/00; A47C 12/02; A47B 77/10; A47B 97/11; A47B 2220/05; A47B 77/00; E06C 1/005; E06C 9/085; A47K 17/028

USPC .. 182/33, 33.5, 33.6, 35, 48, 82, 88, 89, 91, 182/93, 94, 96, 97, 99, 149; 312/235.1, 312/235.2, 235.3, 292; 108/48, 99

See application file for complete search history.

(56) References Cited

U.S. PATENT DOCUMENTS

| | | | | | |
|---|---|---|---|---|---|
| 560,752 | A | * | 5/1896 | Prator | E06C 1/387 182/156 |
| 1,678,378 | A | * | 7/1928 | Campbell | 108/38 |
| 1,682,732 | A | * | 9/1928 | Beard | 182/33.6 |
| 1,821,517 | A | * | 9/1931 | Hyatt | 182/33.6 |
| 2,087,695 | A | * | 7/1937 | Miller | 52/32 |
| 2,136,354 | A | * | 11/1938 | Welsh | 15/265 |
| 2,581,488 | A | * | 1/1952 | Keltner et al. | 182/77 |
| 3,030,166 | A | * | 4/1962 | Baker et al. | 312/235.1 |
| 3,057,670 | A | * | 10/1962 | Russo | 108/48 |
| 3,136,386 | A | * | 6/1964 | Jung et al. | 182/77 |
| 3,311,190 | A | | 3/1967 | Naumann | |
| 3,462,170 | A | * | 8/1969 | Smith et al. | 280/166 |
| 3,756,678 | A | | 9/1973 | Kloppenstein | |
| 3,834,490 | A | * | 9/1974 | Ford | B60R 3/02 182/88 |
| 4,005,898 | A | * | 2/1977 | Way | 296/174 |

(Continued)

*Primary Examiner* — Katherine Mitchell
*Assistant Examiner* — Marcus Menezes
(74) *Attorney, Agent, or Firm* — Russell T. Manning; Marsh Fischmann & Breyfogle, LLP

(57) ABSTRACT

The present invention generally relates to a folding step stool that is, in one embodiment, mounted and stored within a cabinet. Children and short adults are typically not tall enough to readily access a kitchen or bathroom sink. Accordingly, many homes have a portable step stool located in the kitchen or bathroom. While effective, one problem with such a portable step stool is storage of the stool when not in use. Aspects of the present invention are directed to a folding step stool that may be mounted within an interior of a cabinet. When not in use, the entirety of the folding step stool may be disposed within an interior of the cabinet to permit closure of the cabinet door. Likewise, when needed, the cabinet door may be opened and the step stool may be deployed to provide one or more steps for use in accessing a counter or sink above the cabinet.

16 Claims, 8 Drawing Sheets

(56) References Cited

U.S. PATENT DOCUMENTS

| | | | | | |
|---|---|---|---|---|---|
| 4,108,457 | A | * | 8/1978 | Garrett | B60R 3/02 105/447 |
| 4,135,604 | A | | 1/1979 | Ryan | |
| 4,155,609 | A | * | 5/1979 | Skafte et al. | 312/245 |
| D260,683 | S | | 9/1981 | Kokoska | |
| 4,720,116 | A | * | 1/1988 | Williams et al. | 280/166 |
| 4,846,304 | A | * | 7/1989 | Rasmussen | A47B 77/10 182/129 |
| 5,085,290 | A | | 2/1992 | Guirlinger | |
| 5,131,492 | A | * | 7/1992 | Caminiti et al. | 182/77 |
| 5,341,897 | A | * | 8/1994 | Gross | A47B 77/10 182/35 |
| 5,544,592 | A | * | 8/1996 | Leezer | 108/48 |
| 5,655,459 | A | * | 8/1997 | O'Connor et al. | 108/48 |
| 5,819,670 | A | * | 10/1998 | O'Connor | A47C 9/06 108/134 |
| 5,941,342 | A | * | 8/1999 | Lee | B60R 3/02 182/127 |
| 5,967,255 | A | | 10/1999 | Young | |
| 6,378,720 | B1 | * | 4/2002 | Santa Cruz et al. | 220/495.06 |
| 6,425,457 | B1 | | 7/2002 | Lundry | |
| 6,659,224 | B2 | | 12/2003 | Medsker | |
| 6,786,162 | B1 | * | 9/2004 | Volkmer et al. | 108/115 |
| D532,118 | S | * | 11/2006 | Reese | D25/65 |
| 7,716,757 | B2 | | 5/2010 | Sumpton et al. | |
| 7,815,266 | B2 | * | 10/2010 | Sun | G06F 1/18 312/223.1 |
| 7,861,332 | B2 | * | 1/2011 | Sumpton et al. | 4/621 |
| 8,037,557 | B2 | | 10/2011 | Sumpton et al. | |
| 2007/0095612 | A1 | | 5/2007 | Greer | |
| 2013/0186709 | A1 | * | 7/2013 | White | 182/89 |

* cited by examiner 20
52
80
A
36a
70a
36c
36d
24
16

52
70a
80
36a 24
52
70a
80
36a

CABINET MOUNTED STEP STOOL

CROSS-REFERENCE TO RELATED APPLICATIONS

The present application claims the benefit of the filing date of Provisional Patent Application No. 61/840,785 filed on Jun. 28, 2013, the entire disclosure of which is incorporated herein by reference for all purposes.

FIELD

The present disclosure is generally directed to a foldable step stool for use in kitchens and bathrooms. More specifically, the disclosure is directed to a fold-away step stool that folds into the interior of a cabinet when not in use.

BACKGROUND

Children under the age of about seven are typically not tall enough to readily access a kitchen or bathroom sink. Accordingly, many families of small children have a portable step stool located in their kitchen and/or bathroom that allows children to access the sink. While effective, one problem with such a portable step stool is storage of the stool when not in use. That is, when not in use, stools are commonly left on the floor where they take up space, present a tripping hazard and, in some instances, prevent a bathroom door from fully opening or closing.

SUMMARY

Aspects of the presented inventions are directed to a folding step stool that may, in one arrangement, be mounted within an interior of a cabinet. When not in use, the entirety of the folding step stool may be disposed within an interior of the cabinet to permit closure of the cabinet door. Likewise, when needed, the cabinet door may be opened and the step stool may be deployed to provide one or more steps for use in accessing a counter or sink above the cabinet.

In one aspect, the step stool may have a base adapted for connection to a horizontal surface, which may be within an interior of a cabinet or a floor surface. At least one leg (e.g., rearward leg) may be connected to the base and may extend upward from the base. An upper portion of the stop pivotally connects to a rearward portion of a first step. The first step may have a flat surface (e.g., planar surface) adapted to pivot between a vertical and a horizontal position. A forward portion of the first step may be pivotally connected to at least one forward leg. A linkage extends between the rear leg or base and the forward leg and is pivotally connected to these components. The linkage provides an actuating force such that, when the first step rotates from the vertical position to the horizontal position, the linkage displaces the at least one forward leg from a first position substantially parallel to the first step to a second position substantially perpendicular to the first step. When disposed within a cabinet, such movement displaces the forward leg from within the interior envelope of the cabinet to a location and outside the interior envelope of the cabinet.

In the first position, when the at least one forward leg is substantially parallel to the first step in a vertical position, the bottom of the at least one forward leg may be disposed above (e.g., suspended above) the base. That is, the length of the at least one forward leg may be less than a distance between the base and the pivotal connection between the first step and the at least one forward leg, when the first step is in the vertical position.

To maintain the step in the vertical position, one or more retention elements along the length of the step may engage the first leg. In one arrangement, a cantilevered tab extending from a surface of vertical first step is sized to displace over (e.g., snap, etc.) a portion of the forward leg to maintain the forward leg in a fixed positional relationship with the first step when these components are vertically aligned. In a further arrangement, the forward leg may be received within a recessed interior of the bottom of the first step when these components are vertically aligned.

In the second position, when the at least one forward leg is substantially perpendicular to the first step in a horizontal position, the bottom of the forward leg may come in contact with the floor and may support the forward end of the first step. In the case where the stool is mounted within a cabinet, the bottom end of the forward leg may be disposed below the horizontal surface within the cabinet supporting the base of the stool. The forward legs may be longer than the rearward legs in such an arrangement. The length of the at least one forward leg may be adjustable. For instance, the at least one forward leg may have a series of apertures for receiving a fastener of a leg insert in a tube-in-sleeve arrangement. Alternatively and/or additionally the length of the at least one forward leg may be adjustable by at least one adjustable foot (e.g., threaded).

In a further aspect, the step stool may have a second step pivotally connected with the at least one forward leg so that the linkage moves the second step between a vertical and horizontal position when the first step moves between vertical and horizontal positions. The second step may be vertically lower than the first step and may be substantially parallel to the first step when the first step is in the horizontal position. In one arrangement, a free end of the linkage may provide a support for the second step. That is, the second step may be an extension of the linkage. The linkage may deploy the second step from a vertical position to a horizontal position as the stool is deployed.

In one embodiment, the linkage may be a four bar linkage defined by the at least one rear leg, the first step, the at least one forward leg, and a linkage bar extending between the base/rearward leg and the forward leg. At least one pivotal connection of the four-bar linkage may further include a torsional element. The torsional element may comprise a torsion spring. In any arrangement the torsional element may provide resistance to movement of the first step between the first and second positions. Such resistance may prevent uncontrolled dropping of the stool from the stowed to deployed position.

A method of deploying the step stool may comprise mounting a base to a generally horizontal surface in a cabinet. Once mounted, a first step mounted to the base by a pivotally connected rear leg may be rotated from a vertical position to a horizontal position. A linkage connected to the base and or rear leg may displace a one forward leg from a position juxtaposed against first step when the step is in a vertical position to a position traverse to the first step when first step is in a horizontal position. Likewise, the linkage may displace a second step, which moves from a vertical position substantially parallel with the first step when the first step is in the vertical position to a horizontal position substantially parallel to and vertically lower than the first step when the first step is in the horizontal position.

DETAILED DESCRIPTION

Reference will now be made to the accompanying drawings, which at least assist in illustrating the various pertinent features of the presented inventions. The following description is presented for purposes of illustration and description and is not intended to limit the inventions to the forms disclosed herein. Consequently, variations and modifications commensurate with the following teachings, and skill and knowledge of the relevant art, are within the scope of the presented inventions. The embodiments described herein are further intended to explain the best modes known of practicing the invention and to enable others skilled in the art to utilize the invention in such, or other embodiments and with various modifications required by the particular application(s) or use(s) of the presented inventions.

Presented herein is one embodiment of a step stool that may be mounted within a cabinet beneath a countertop and/or sink. The step stool has particular applicability for use in bathrooms where space is limited. However, the step stool is not limited to any particular application. For instance, such a step stool may also be utilized by short adults to reach upper cabinets, the step stool may be used in the kitchen, etc. Generally, the step stool is adapted for disposition within the interior of a cabinet or vanity such that the step stool may be disposed entirely within the cabinet when not in use. When needed, the cabinet door may be opened and the step stool may be deployed to provide one or more steps to provide access for children and/or small adults to a countertop, sink, and/or upper cabinets.

Figure 1:
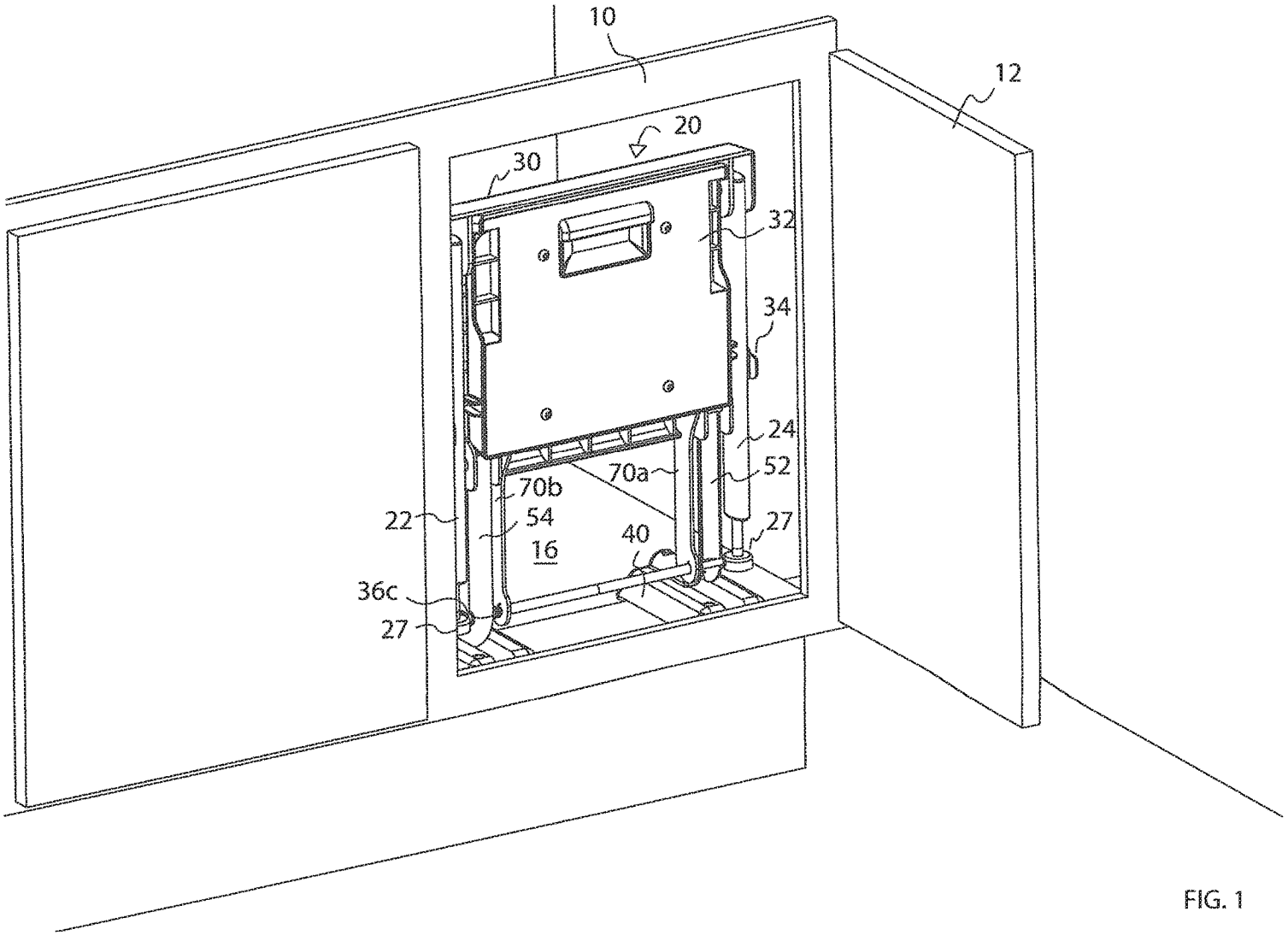
FIG. 1 is a perspective view of the step stool in a stowed position, mounted in a cabinet.
Figure 2:
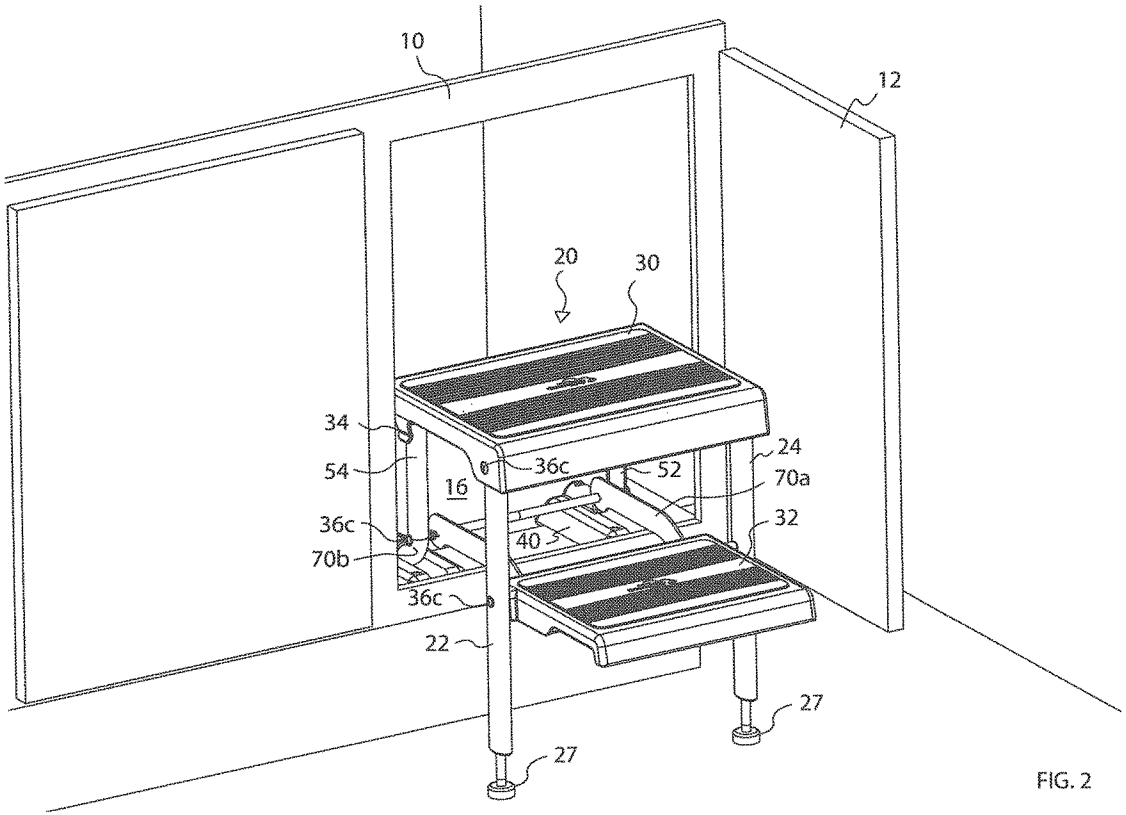
FIG. 2 is a perspective view of the stool in a fully deployed position, mounted in a cabinet.

The figures illustrate one non-limiting embodiment of a folding step stool 20. Similar components are co-described herein with like elements having common reference numbers. FIGS. 1 and 2 illustrate the folding step stool 20, which may be entirely disposed within a cabinet 10 (i.e., within a spatial envelope of the cabinet), when not in use. The cabinet may be located in a bathroom, in a kitchen, etc. More specifically, FIG. 1 illustrates the step stool 20 in a folded configuration (e.g., non-deployed) such that the step stool 20 is entirely disposed within an interior of the cabinet 10. In this configuration, the cabinet door 12 may be closed such that the step stool 20 is entirely hidden from view. (See e.g., FIG. 3.) FIG. 2 illustrates the step stool 20 in a deployed configuration. In the deployed configuration, the cabinet door 12 is opened and the step stool 20 is folded out of the interior of the cabinet 10 such that at least a first forward leg and more typically first and second forward legs 22, 24 contact a floor surface 14. These forward legs 22, 24 support at least a first step 30 and, in the illustrated embodiment, a second step 32. While the step stool 20 may be entirely disposed within the cabinet 10, the stepstool folds to have a shallow depth such that area in the cabinet behind the stepstool is available for storage. See FIG. 3. Further, this area may be easily accessed by deploying the stool as shown in FIG. 2.

Figure 3:
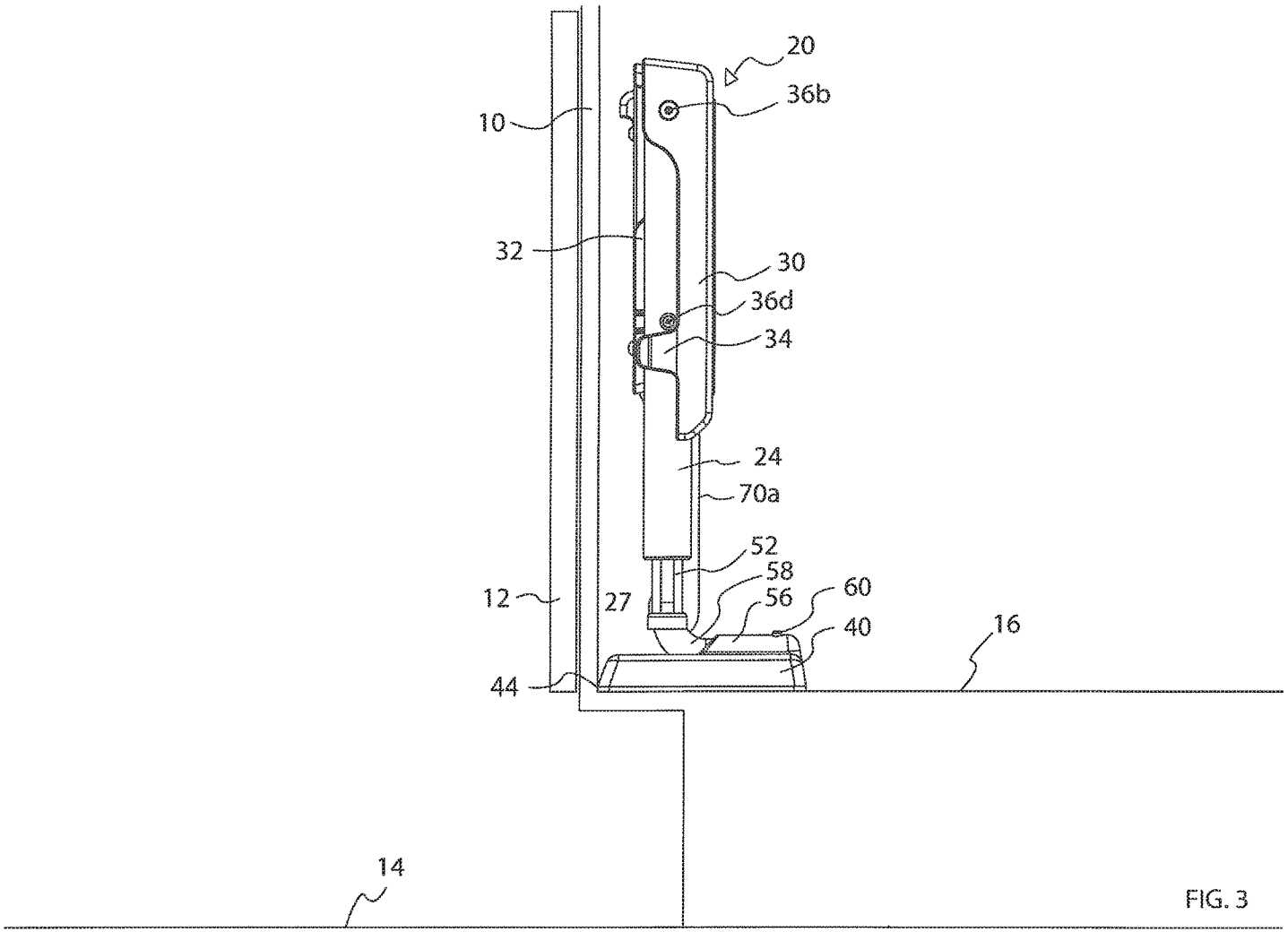
FIG. 3 is a side view of the stool in a stowed position, mounted in a cabinet.
Figure 4:
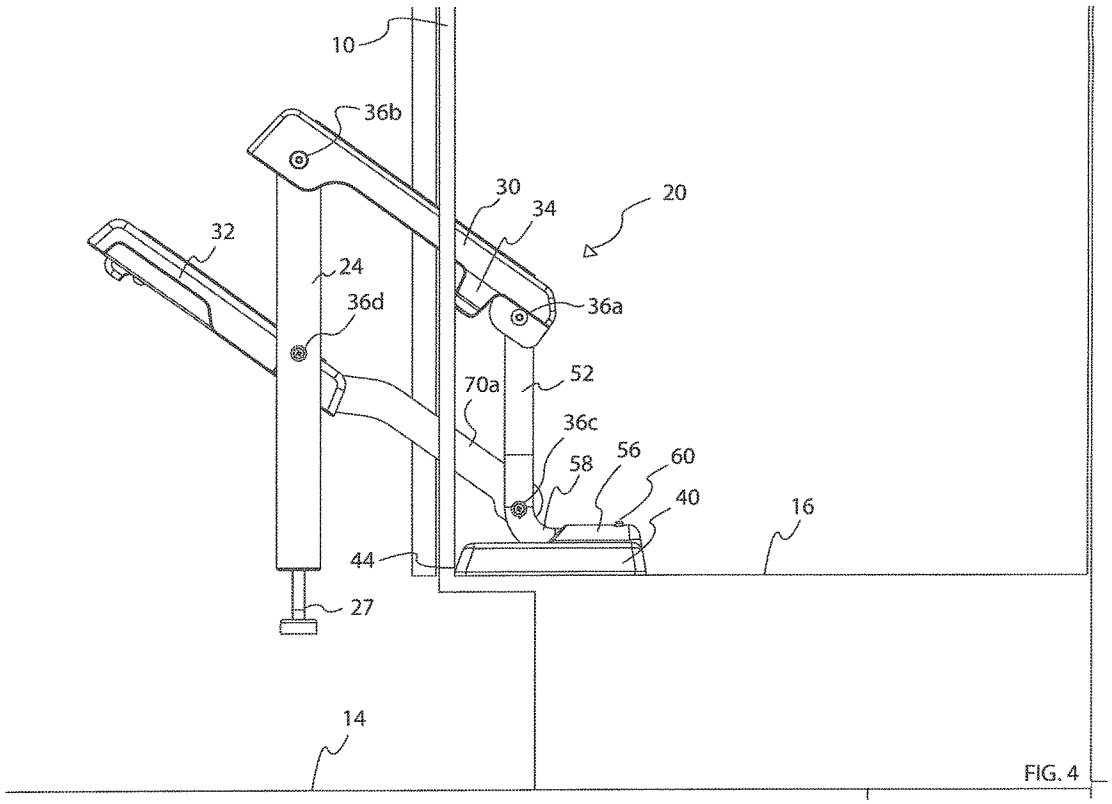
FIG. 4 is a side view of the stool in a partially deployed position, mounted in a cabinet.
Figure 5:
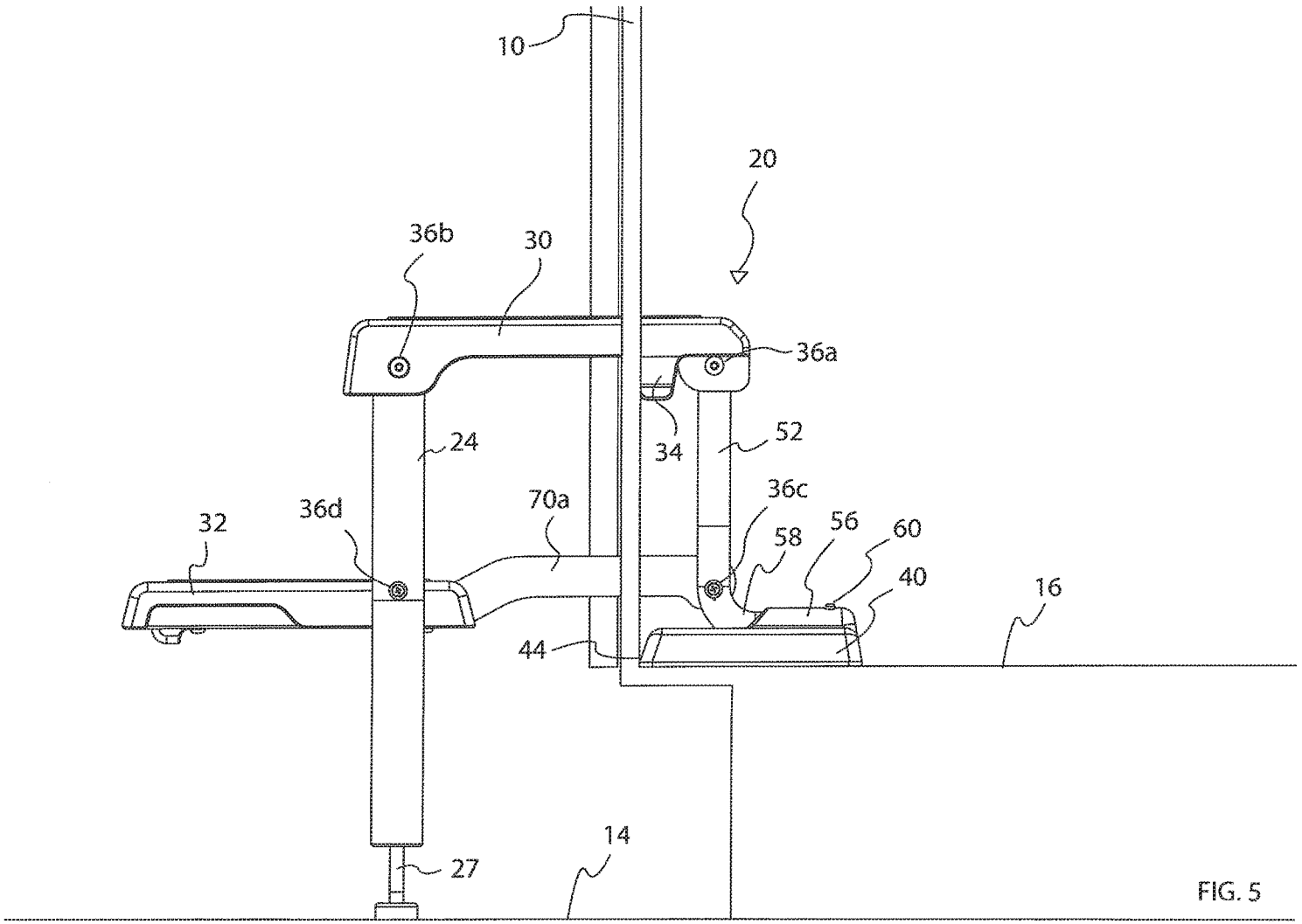
FIG. 5 is a side view of the stool in a fully deployed position, mounted in a cabinet.

FIGS. 3-7 illustrate view of the step stool 20 in a folded side configuration, a partially deployed side configuration, a fully deployed side configuration, a folded perspective configuration, and a fully deployed side configuration, respectively. As shown, the stepstool 20 includes a base 40 that is adapted for mounting on a generally horizontal interior surface 16 of the cabinet 10. As shown in FIGS. 3-5, the base 40 has a front edge 44 that can be used to correctly position the base 40 and connected stool within the interior of the cabinet 10. That is, the front edge 44 of the base 40 can be juxtaposed relative to the front surface of the cabinet edge or lip to correctly position the base 40. At this time, one or more fasteners 42 (e.g., wood screws) may be inserted through one or more apertures in the base 40. See for instance FIG. 7. Other attachment mechanisms may be utilized including, for example, adhesives.

As shown in FIGS. 3-7, the base 40 supports first and second rear legs 52, 54. These legs 52, 54 may be interconnected to the base 40 in any appropriate manner. In one embodiment, collets 56 are horizontally aligned in the top surface of the base. Such horizontal collets 56 each receive a curved lower portion 58 of a corresponding rear leg. The base may be injected molded or may be made of pressed metal. However, this is not a requirement. In another embodiment, collets may be vertical and the rear legs may lack the curved lower portion (not shown). Other connection between the base and rear legs is possible.

As shown in FIGS. 3-7, each rear leg 52, 54 has a curved lower portion 58 that is received in their respective collet 56. The curved lower portion 58 of each rear leg 52, 54 is secured to the respective collet 56 by one or more fasteners 60. The rear legs 52, 54 extend upwardly from the curved lower portions 58 and connect to a rearward portion of the first step 30. More specifically, the upper ends of the rear legs 52, 54 are pivotally connected to the rear edge of the first step 30 via a first pivotal connection 36*a*. This pivotal connection 36*a* may utilize any appropriate pin, bolt or other fastener. Likewise, the forward legs 22, 24 are pivotally connected to the forward edge of the first step 30 via a second pivotal connection 36*b*. The pivotal connections 36*a*, 36*b* of the rear and forward legs to the first step allows for pivotal movement of the step from the non-deployed position as illustrated in FIG. 3 to the deployed position as illustrated in FIG. 5. In this regard, the top planar surface of the first step 30 may be rotated from a vertical position as shown in FIG. 3 to a horizontal position as illustrated in FIG. 5.

Figure 6:
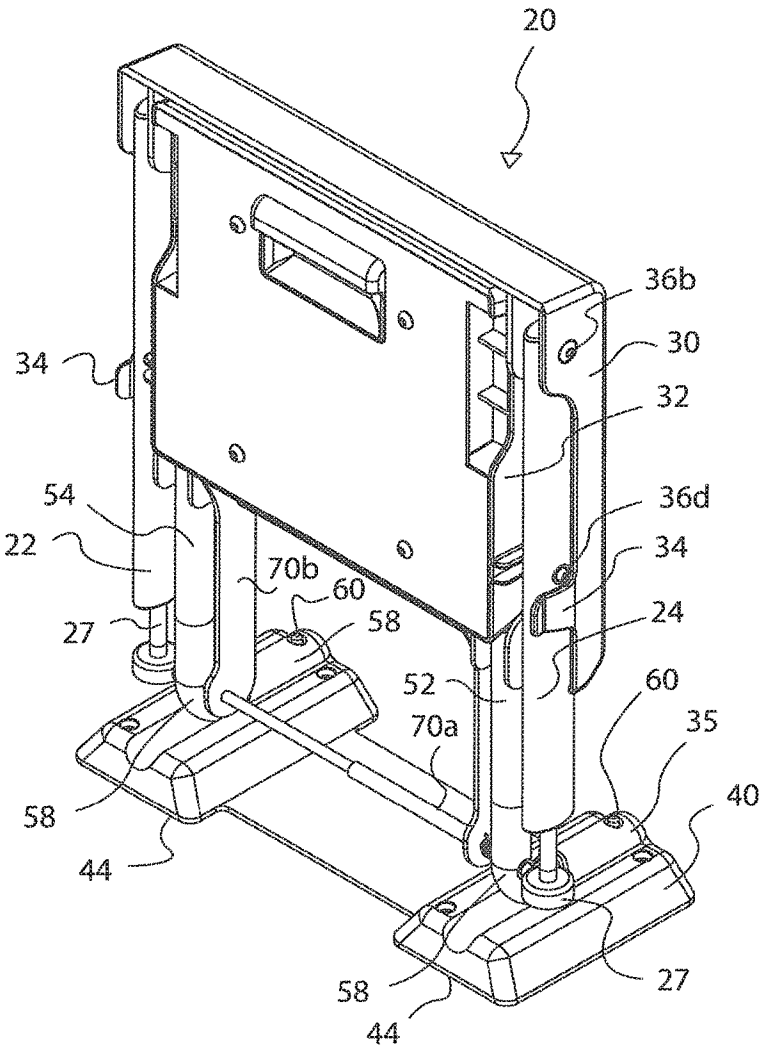
FIG. 6 is a perspective view of the stool in a stowed position.
Figure 7:
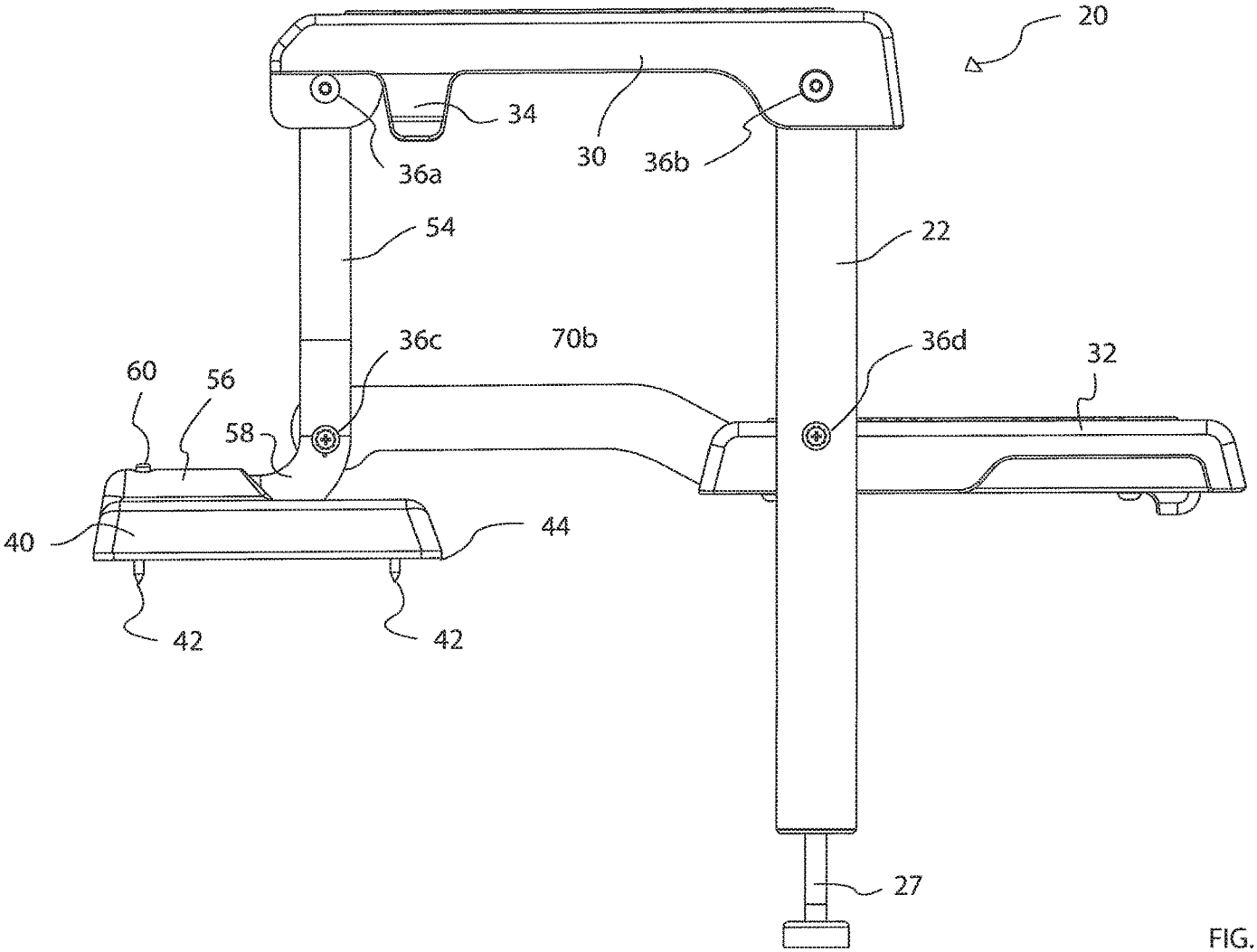
FIG. 7 is a side view of the stool in a fully deployed position.

As best illustrated in FIG. 6, the forward legs 22, 24 are connected such that they pivot to a substantially vertical position when the first step 30 is in the vertical position. More particularly, in the illustrated embodiments, the forward legs 22, 24 are received within a recessed interior of the bottom surface of the step 30 in the vertical position to minimize the overall depth of the stool 20 in the non-deployed position. In the illustrated embodiment, cantilevered tabs 34 extend from the sides of the first step and displace over (e.g., snap over, etc.) the forward legs 22, 24 when the step is in the vertical position. The tabs maintain the forward legs 22, 24 in a fixed positional relationship with the first step. That is, the tab(s) provide a retainer for maintaining the step in the vertical position.

As illustrated, the forward legs 22, 24 are longer than the rear legs 52, 54. This is often necessary as the base of the stool is disposed within the interior of the cabinet 10 at a vertical height above the floor 14. See FIGS. 2 and 5. However, the height of the interior floor surface of different cabinets varies. That is, there is no standard interior height for the bottom floor of a cabinet. Therefore, to allow the steps 30, 32 of the stool to be disposed in a substantially flat horizontal orientation when the stool is deployed, it may be necessary to adjust the length of the first and second forward legs 20, 22. To achieve such adjustment, each of the first and second forward legs may utilize a tube-in-sleeve arrangement (not shown) where each forward leg has an adjustable lower insert. Accordingly, these lower insert portions may be adjusted to a desired length by sliding these lower portions to a desired position within their respective leg. Alternatively and/or additionally, adjustment of the length of each forward leg 22, 24, may be provided by an adjustable foot 27. See FIG. 5. Such an adjustable foot 27 may be threaded into the lower end of each forward leg 22, 24. This adjustable foot may have a threaded shaft having a length that allows for adjusting the overall length of the leg. However, it will be appreciated that the adjustment length of the forward legs 22, 24 may be performed in any appropriate manner.

In the illustrated embodiment, the stool 30 also includes a second step 32, which is at least partially supported by the first and second forward legs 22, 24. In the illustrated embodiment, the lower step is pivotally connected between the forward legs 22, 24. The second step 32 is configured to be deployed at a vertical position lower than the first step 30. In this regard, the stepstool 20 provides first and second steps for use in accessing a counter or sink.

To allow for the automatic displacement of the forward legs 22, 24 as the first step 30 is rotated from the non-deployed position (e.g., vertical position) to the deployed position (e.g., horizontal position), the step stool further incorporates cross linkages 70*a*, 70*b* (see FIG. 6, hereafter cross linkage 70 unless specifically referenced). In the present embodiment, free ends of the cross linkage form a support for the second step 32 as shown in FIG. 2. In another embodiment, the cross linkages and second step may be separate members (not shown). In the illustrated embodiment, each cross linkage 70 has a first end pivotally connected proximate to the base of the rear legs 52, 54 via a third pivotal connection 36*c* and a mid portion pivotally connected 36*d* to one of the forward legs 22, 24 via a fourth pivotal connection 36*d*. In the illustrated embodiment, a second free end of each cross linkage 70 extends beyond the front legs and form cantilever supports for the planar surface of the second step 32, which extends between the second free ends of the linkages.

The linkage 70 provides the actuating force that, during rotation of the first step from the vertical position to the horizontal position, displaces the forward legs forward such that they move out of the interior envelope of the cabinet and come in contact with the floor surface 14. The rear legs 52, 54, first step 30, forward legs 22, 24, and the linkage 70 effectively define a four bar linkage/closed chain movable linkage. It consists of four bodies connected in a loop by four pivoting joints, e.g., 36*a*, 36*b*, 36*c* and 36*d*. One link of the chain (i.e., rear legs 52, 54) is usually fixed, and is called the ground link, fixed link, or the frame. The two links connected to the frame (first step 30 and linkage 70) are called the grounded links and are generally the input and output links of the system, sometimes called the input link and output link. The last link (i.e., forward legs 22, 24) is the floating link, which is also called a coupler or connecting rod because it connects an input to the output. Such a four bar linkage allows the stool to fold into a substantially flat configuration as illustrated in FIGS. 1, 3, and 6. Further, the four-bar linkage is operative to lift the bottom ends of the first and second forward legs above the base of the cabinet to allow these legs to fold into the interior of the cabinet when not in use.

As noted, the second ends of the linkages 70 form cantilevered supports for the lower step 32. In this regard, the linkage and lower step form a single bar of the four-bar linkage where a rearward end of the linkage/lower step bar is pivotally connected 36*c* to the rear legs 52, 54 and a mid portion of the linkage/lower step bar is pivotally connected 36*d* to the forward legs 22, 24. In this embodiment, the linkage directly deploys the second step from a vertical position to a horizontal position as the stool is deployed. In another embodiment, the rearward end of the linkage/lower step bar is pivotally connected to the base.

Figures 8A, 8B, 8C:
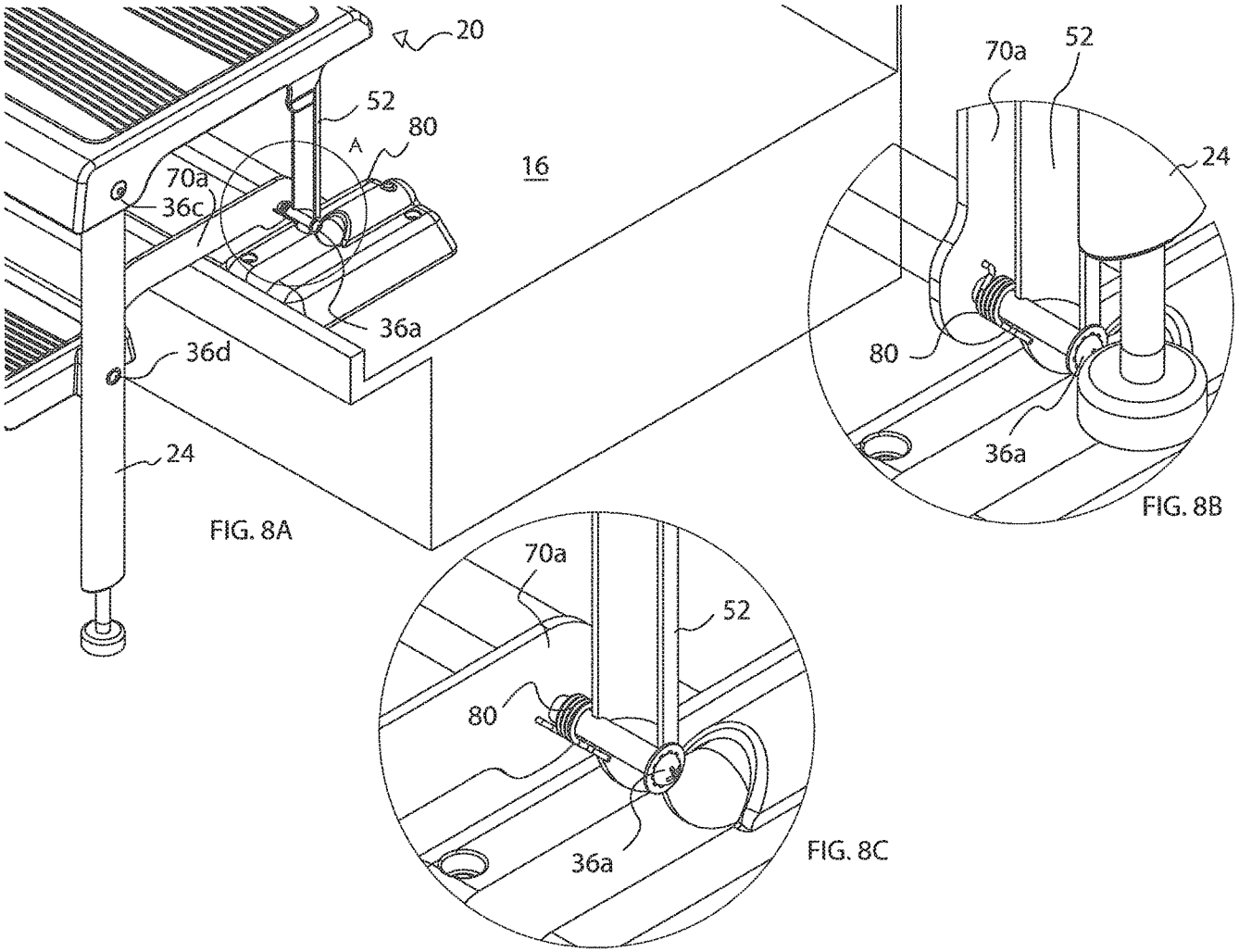
FIG. 8A is a perspective view of the torsion spring with the stool in a fully deployed position, mounted in a cabinet.
FIG. 8B is a closer perspective view of the torsion spring with the stool in a stowed position, mounted in a cabinet.
FIG. 8C is a closer perspective view of the torsion spring with the stool in a fully deployed position, mounted in cabinetry.

In one embodiment, at least one pivotal connection 36 of the four bar linkage may further include a torsional element to allow for a slow descent of the stool. See FIGS. 8A-8C. As shown in FIG. 8A, a torsion spring 80 is attached to one of the pivotal connections 36, in the illustration it is attached to the pivotal connection 36*a* between the linkage 70 and rear leg 52, which is shown in cross-section for purposes of discussion. The torsion spring 80 is closed when the step is stowed (FIG. 8B) and expands as the step is deployed (FIG. 8C), thereby, resisting the deployment of the stool 20, but balanced with the weight of the stool 20 to allow a slow descent of the stool 20 until the forward legs 22, 24 come in contact with the floor 14. The torsion spring 80 also helps when returning the stool to the stowed position because the torsion spring 80 is going back to its natural state.

Though described in a primary embodiment utilized in cabinets having a raised interior surface, it will be appreciated that the stool may be utilized in other applications. For instance, the stool may be utilized in applications where it is not enclosed within the interior of a cabinet. Such stool may be utilized in, for example, public restrooms. In such an application, the base of the stool may be fixedly attached to a floor surface. In such an arrangement, the rearward and forward legs may be of substantially the same length.

The foregoing description has been presented for purposes of illustration and description. Furthermore, the description is not intended to limit the inventions and/or aspects of the inventions to the forms disclosed herein. Consequently, variations and modifications commensurate with the above teachings, and skill and knowledge of the relevant art, are within the scope of the presented inventions. The embodiments described hereinabove are further intended to explain best modes known of practicing the inventions and to enable others skilled in the art to utilize the inventions in such, or other embodiments and with various modifications required by the particular application(s) or use(s) of the presented inventions. It is intended that the appended claims be construed to include alternative embodiments to the extent permitted by the prior art.

What is claimed is:

1. A step stool comprising:

a base adapted to connect the step stool to a generally horizontal surface within an interior of a cabinet;

at least one rear leg fixedly connected to the base wherein the at least one rear leg extends upward relative to the generally horizontal surface from the base;

a first step wherein a rearward portion of the first step is pivotally connected to an upper portion of the at least one rear leg, the first step having a first planar surface that pivots between a substantially vertical position and a substantially horizontal position;

at least one forward leg pivotally connected to a forward portion of the first step;

a second step pivotally connected along a length of the at least one forward leg, the second step having a second planar surface that pivots between a substantially vertical position and a substantially horizontal position;

a linkage wherein a first portion of the linkage is pivotally connected proximate to the base on the at least one rear leg and a second portion of the linkage is pivotally connected to the at least one forward leg, wherein the linkage provides actuating force that during rotation of the first step and second step from the vertical positions to the horizontal positions, the linkage displaces the at least one forward leg from a first position located against the first step when the first step is in the vertical position to a second position substantially transverse to the first step when the first planar surface of the first step is in the horizontal position; and wherein in said first position of the at least one forward leg, said second step is disposed vertically in front of said first step and in said second position of the at least one forward leg said second step is cantilevered such that a majority of said second planar surface is disposed in front of a front edge of said first planar surface of said first step.

2. The step stool of claim 1 wherein the second step is in a horizontal position vertically lower than the first step when the first planar surface of the first step is in the horizontal position.

3. The step stool of claim 1 wherein the second step is in a substantially parallel orientation with the first step when the first planar surface of the first step is in the vertical position.

4. The step stool of claim 1 wherein the linkage is rigid between an outward end of the second step and pivotal connection proximate to the base of the at least one rear leg.

5. The step stool of claim 1 wherein in the first position of the at least one forward leg, a lower end of the at least one forward leg is suspended above the generally horizontal surface within the interior of the cabinet.

6. The step stool of claim 1 wherein in the second position of the at least one forward leg, a lower end of the at least one forward leg comes in contact with a support surface disposed below the generally horizontal surface and the at least one forward leg supports the forward portion of the first step.

7. The step stool of claim 1 further comprising:

at least one cantilevered tab extending from the first step, wherein the cantilevered tab engages the at least one forward leg when the first planar surface of the first step is in the vertical position.

8. The step stool of claim 1 wherein the first step further comprises:

a recess in a bottom surface, wherein the at least one forward leg is at least partially received within the recessed bottom surface of the first step when the first planar surface of the first step is in the vertical position.

9. The step stool of claim 1 wherein a length of the at least one forward leg is adjustable.

10. The step stool of claim 9 wherein the at least one forward leg has at least one adjustable foot.

11. The step stool of claim 1 wherein the at least one rear leg, the first step, the at least one forward leg, and the linkage form a four-bar linkage.

12. The step stool of claim 11 wherein at least one pivotal connection of the four-bar linkage is a torsional element.

13. The step stool of claim 12 wherein the torsional element comprises a torsion spring.

14. A step system, comprising:

a cabinet having:

an interior horizontal surface disposed vertically above a floor surface supporting said cabinet, wherein a base is fixedly attached to said interior horizontal surface of said cabinet;

an opening in a front side of said cabinet; and a cabinet door operative to move from a closed position over said opening to an open position where said opening is exposed;

the base adapted for fixed attachment to said interior horizontal surface;

at least one rearward leg fixedly attached to said base and extending vertically relative to said interior horizontal surface above said base;

a first step having a first planar surface wherein a rearward end of said first step is pivotally connected proximate to a top end of said rearward leg;

at least one forward leg having a top end pivotally connected to a forward end of said first step, wherein said forward leg has a length that is greater than a length of said rearward leg; and a linkage having a first end pivotally connected proximate to a location where said rearward leg connects to said base, a mid portion pivotally connected along the length of said forward leg, and a free end;

a second step connected to said free end of said linkage and having a second planar surface, wherein said first step and said second step are adapted to rotate from a first position where said first and second planar surfaces are substantially vertical and an axis of said forward leg is located against said first step to a second position where said first and second planar surfaces are substantially horizontal and said axis of said forward leg is transverse to said first step; and wherein said second step is cantilevered such that a majority of said second planar surface is disposed in front of a front edge of said first planar surface of said first step.

15. The step system of claim 14 wherein the second planer surface of the second step is vertically lower than the first planer surface of the first step when the first and second steps are in said second position.

16. The step of claim 14, wherein in said first position, said cabinet door may move to said closed position.

* * * * *